US008689933B2

(12) United States Patent
Bulat

(10) Patent No.: US 8,689,933 B2
(45) Date of Patent: Apr. 8, 2014

(54) HELMHOLTZ RESONATOR FOR A GAS TURBINE COMBUSTION CHAMBER

(75) Inventor: Ghenadie Bulat, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/497,091

(22) PCT Filed: Sep. 14, 2010

(86) PCT No.: PCT/EP2010/063487
§ 371 (c)(1),
(2), (4) Date: May 8, 2012

(87) PCT Pub. No.: WO2011/036073
PCT Pub. Date: Mar. 31, 2011

(65) Prior Publication Data

US 2012/0228050 A1 Sep. 13, 2012

(30) Foreign Application Priority Data

Sep. 23, 2009 (EP) ..... 09012116

(51) Int. Cl.
*F01N 1/12* (2006.01)
*F02C 7/24* (2006.01)
*F02K 1/00* (2006.01)
*F02K 1/82* (2006.01)

(52) U.S. Cl.
USPC ..... 181/213; 181/279; 181/280; 60/725

(58) Field of Classification Search
USPC ..... 181/213; 60/725
See application file for complete search history.

(56) References Cited

U.S. PATENT DOCUMENTS

| | | | | |
|---|---|---|---|---|
| 2,573,536 | A * | 10/1951 | Bodine, Jr. | 123/265 |
| 2,644,512 | A * | 7/1953 | Durr et al. | 431/1 |
| 3,286,786 | A * | 11/1966 | Wirt | 181/213 |
| 3,320,744 | A * | 5/1967 | Blakely et al. | 60/749 |
| 3,687,221 | A * | 8/1972 | Bonnard | 181/180 |
| 4,137,992 | A * | 2/1979 | Herman | 181/213 |
| 6,415,888 | B2 * | 7/2002 | An et al. | 181/281 |
| 6,640,544 | B2 * | 11/2003 | Suenaga et al. | 60/725 |
| 8,307,945 | B2 * | 11/2012 | Todorovic | 181/213 |
| 2008/0216481 | A1 * | 9/2008 | Pollarolo | 60/725 |
| 2013/0025282 | A1 * | 1/2013 | Bulat | 60/725 |

FOREIGN PATENT DOCUMENTS

| | | | |
|---|---|---|---|
| DE | 4105057 | A1 | 8/1992 |
| DE | 19640980 | A1 | 4/1998 |
| DE | 10006231 | A1 | 8/2001 |

(Continued)

*Primary Examiner* — David Warren
*Assistant Examiner* — Christina Russell

(57) ABSTRACT

A resonator is provided, having an adaptable resonator frequency for absorbing sound generated by a gas stream of a gas turbine. The resonator includes a neck section, a chamber and a deformable element being deformable under influence of a change of a gas turbine temperature of the gas stream. The shape of the deformable element is predetermined with respect to a respective gas turbine temperature. The neck section and the chamber form a volume of the resonator. The neck section forms a passage coupling the volume with the gas turbine. The deformable element is thermally coupled to the gas turbine in such a way that the shape of the deformable element depends on the respective gas turbine temperature. The deformable element forms a spiral and is installed to the neck section in such a way that an effective diameter of the neck section depends on the gas turbine temperature.

9 Claims, 3 Drawing Sheets

(56) References Cited

FOREIGN PATENT DOCUMENTS

| | | | | | |
|---|---|---|---|---|---|
| EP | 0111336 | A2 | | 6/1984 | |
| GB | 2288660 | A | * | 10/1995 | ..... F23M 13/00 |
| JP | 11044266 | A | * | 2/1999 | ..... F02M 35/12 |
| RU | 2212589 | C1 | | 9/2003 | |
| SU | 1703921 | A1 | | 1/1992 | |

* cited by examiner

HELMHOLTZ RESONATOR FOR A GAS TURBINE COMBUSTION CHAMBER

CROSS REFERENCE TO RELATED APPLICATIONS

This application is the US National Stage of International Application No. PCT/EP2010/063487, filed Sep. 14, 2010 and claims the benefit thereof. The International Application claims the benefits of European application No. 09012116.1 filed Sep. 23, 2009. All of the applications are incorporated by reference herein in their entirety.

FIELD OF INVENTION

The present invention relates to a resonator with an adaptable resonator frequency for absorbing sound or combustion dynamics peaks generated by a gas stream of a gas turbine. Furthermore, the present invention relates to a gas turbine comprising at least one resonator. Moreover, the present invention relates to a method of producing a resonator with an adaptable resonator frequency for absorbing sound generated by a gas stream of a gas turbine.

ART BACKGROUND

In today's gas turbines it is an aim to burn the fuel in the combustion chamber in a lean mixture of air and fuel. Such kind of gas turbines may be called dry low emission (DLE) combustion systems, whereby the combustion of the lean fuel mixture produces low NOx rate and compact flames. "NOx" stands for mono nitrogen oxides, i.e. the chemical compounds NO or $NO_2$. However, these systems are prone to combustion dynamics as they run in a lean regime due to the use of the lean mixture of air and fuel. Hence, combustion dynamics may arise as a result of flame excitation, aerodynamic induced excitation or insufficient damping.

The combustion dynamics may cause high acoustic noises wherein it is an aim to reduce those combustion dynamics and those noises, in particular the sound that is generated by the dry low emission combustion systems.

Therefore, in conventional gas turbines, acoustic damping of the critical frequency is performed. Thus, damping devices are installed that are placed directly to the combustion chamber or inside the casings of the gas turbines. The damping devices may be formed of Helmholtz resonator dampers or perforated liners.

Helmholtz resonators are known to be very effective at damping a critical frequency experienced by the gas turbine system. Normally the Helmholtz resonators are designed to target a single critical frequency experience at a single load point of the gas turbine. When the load of the gas turbine is altered, in particular for example between 50% and 75%, the combustion system might be prone to the combustion dynamics. The temperature due to different loads of the gas turbine may be changed and therefore the resonating frequency of the Helmholtz device might not cover the critical frequency experience by the combustion system.

In conventional gas turbines, this problem is overcome by using a set of a plurality of Helmholtz resonators with different resonating frequencies that are used to damp different frequencies generated by the combustion dynamics. For this approach, a high number of parts and costs are necessary. Moreover, the use of a plurality of Helmholtz resonators might not always be appreciable due to geometrical constraints of the gas turbine.

EP 0 111 336 A2 discloses a resonator for internal combustion engines. The resonator is adapted to absorb resonant noises from an engine by appropriately changing the length and the cross-sectional area of a tubular connecting member between the resonator and the engine. The change of the length and/or the cross-sectional area may be controlled by an actuator which is controlled by an electrical signal corresponding to a resonant frequency calculated by a computer.

WO 94/19596 A1 discloses a silencer for attenuating discharge noises in installations with pulsating gas flows. A variable Helmholtz resonator is used, wherein a regulating member influencing the Helmholtz resonator is linked to a frequency measurement device. The regulating member may be controlled by a control unit for changing the length and the cross-section of a neck of the Helmholtz resonator.

DE 196 40 980 A1 discloses a device for damping the noise of a combustion chamber. A Helmholtz resonator is used, wherein a neck part of the Helmholtz resonator provides a wall that may act as a spring-shaped wall or as a bellow that may be enlarged and reduced in its size for amending the frequency characteristics of the Helmholtz resonator.

JP 60022021 A discloses a device for lowering the noise level of an engine effectively by providing resonance chambers. The chambers are connected via a connecting pipe that comprises valves for providing an airstream.

JP 58093955 A discloses a device for reducing intake air sound and for reducing noise during engine running. Therefore, the volume of a resonance chamber may be made variable by controlling a piston for changing the volume of the resonator.

JP 60182348 A discloses a device for reducing a noise in an engine by controlling the length of a resonance passage, a sectional area and a volume in the resonance chamber. Thereby a piston is installed that may be controlled in order to change the characteristics of the resonance passage.

SU 767824 describes a bimetallic plate to which an electric current may be applied from a source via regulator. The bimetallic plates may vibrate at the inlet of a close space of a resonance.

JP 11044266 A1 discloses a resonator for enabling a compensation of frequency according to a temperature change. A communication pipe couples a gas pipe with a volume part of a Helmholtz type resonator. Communication pipe radius control means reduce the radius of the communication pipe according to a change in ambient temperature. The communication pipe radius control means comprises a leaf and an expansion and contraction member. The leaf forms an inner diameter of the communication pipe. The expansion and contraction member controls the inner diameter of the leaf according to temperature changes.

SUMMARY OF THE INVENTION

It may be an object of the present invention to provide a proper acoustical damping system for a gas turbine.

In order to achieve the object defined above, a resonator with an adaptable resonator frequency for absorbing sound generated by a gas stream of a gas turbine, a gas turbine with the resonator and a method of producing the resonator with an adaptable resonator frequency for absorbing sound generated by a gas stream of a gas turbine according to the independent claims are provided. The dependent claims describe advantageous developments and modifications of the invention.

According to a first exemplary embodiment of the present invention, a resonator with an adaptable resonator frequency for absorbing sound generated by a gas stream of the gas turbine is provided. The resonator comprises a neck section, a chamber and a deformable element being deformable under influence of a change of a gas turbine temperature (e.g. a temperature of a turbine wall and/or a gas temperature of the gas stream) of the gas turbine. The deformable element forms a spiral. The shape of the deformable element is predetermined with respect to a respective gas turbine temperature. The neck section and the chamber form a volume of the resonator, wherein the neck section forms a passage coupling the volume with a gas turbine. The deformable element is thermally coupled to the gas turbine temperature in such a way that the shape of the deformable element depends on the respective gas turbine temperature. The deformable element is installed to the neck section in such a way that an effective diameter of the neck section depends on the gas turbine temperature. In particular, a shape of the spiral depends on the respective gas turbine temperature for selectively adapting the effective diameter of the neck section.

According to a further exemplary embodiment, a gas turbine is provided comprising at least one above described resonator.

According to a further exemplary embodiment, a method of producing a resonator with an adaptable resonator frequency for absorbing sound generated by a gas stream of a gas turbine is provided. According to the method, a volume of the resonator is formed by a neck section and a chamber. Moreover, a passage is formed by the neck section wherein the passage couples the volume to the gas turbine. The deformable element forms a spiral and is thermally coupled to the gas volume in such a way that the shape of the deformable element depends on the respective gas turbine temperature. The deformable element is installed to the neck section in such a way that an effective diameter of the neck section depends on the gas turbine temperature. In particular, a shape of the spiral depends on the respective gas turbine temperature for selectively adapting the effective diameter of the neck section.

The resonator, e.g. a Helmholtz resonator, may provide a certain resonance frequency, also depending upon the actual form of the inventive deformable element, as discussed later. When the resonator frequency is adapted to a frequency of the acoustical wave of the oscillating gas stream of the gas turbine, the resonator may absorb the peaks of the vibration of the acoustical waves produced by the gas stream.

The resonator comprises in particular a chamber and a neck section. In general, the chamber provides a larger volume than the smaller neck section. The neck section may be connected to the system that has to be acoustically damped, i.e. to the gas stream of the gas turbine.

Because the neck section forms a passage to the inside of the gas turbine and thus to the gas stream, the pressure of the gas inside the chamber and the neck section may be adapted to the pressure of the gas stream of the gas turbine. By the vibration of the acoustical waves produced by the gas stream the pressure in the neck section and the chamber increases or decreases. When the gas pressure outside of the chamber is decreased, the gas with higher pressure inside the chamber will flow out and vice versa. However, this surge of gas flowing in and out of the resonator will depend on the inertia of the gas in the neck section and the pressure inside the neck section will be left at the pressure slightly lower or higher than effectively outside. This process repeats and forms a definable frequency. This frequency may be adjusted exactly to a frequency of the vibration of the acoustical waves generated by the gas stream of the turbine.

The frequency, in particular the resonant frequency, of the resonator is dependent on geometrical constraints of the resonator, as is shown in the following formula:

$$\text{Frequency: } f = \frac{c}{2\pi}\sqrt{\frac{S}{l \cdot V}}$$

wherein

S is the cross-sectional area of the neck section of the resonator (wherein S may e.g. be calculated for circle cross-section with $\pi r^2$), V is the resonator's volume, l is the effective length of the resonator's neck section which is based on the geometric neck length, and c is the speed of sound.

Taking into account the above-described formula, by amending the geometrical constraints S, l and V, the frequency of the resonator may be adjusted to the frequency of the acoustical waves generated by the gas stream of the turbine.

Moreover, the speed of sound, as can be taken from the formula for the resonator's frequency, is temperature-dependent. Hence, besides the geometrical constraints also the temperature of the gas stream and of the resonator respectively have to be taken into account in order to calculate an accurate frequency for damping acoustical waves. The temperature dependency is based on the following formula for the speed of sound:

$$c = \sqrt{\frac{\kappa \cdot R \cdot T}{M}},$$

wherein:

κ is the adiabatic index,

R is the molar gas constant,

T is the gas stream temperature, and

M is the molar mass in kg/mol.

The gas stream temperature dependency leads to a change of the resonating frequency so that the acoustic peaks of the acoustical waves caused by the gas stream of the gas turbine may no longer be absorbed in a conventional resonator. In other words, if the operating temperature of the gas turbine is changing, a conventional resonator may become useless because its frequency, i.e. resonator frequency, does not cover the critical frequency the acoustical waves generated by the system, i.e. the critical frequency of the acoustical waves generated by the gas stream.

As described above, in conventional gas turbines, multiple resonators of different resonator frequencies are used in order to provide a resonator damping for all loads of the turbine, i.e. for each temperature, that may occur in the gas turbine. Other conventional acoustical damping systems use complex control mechanics wherein movable actuators are controlled by external control devices for changing the geometrical constraints of the resonator to adapt the resonator to a certain desired frequency.

By the present invention a temperature sensitive deformable element may be installed either in the neck section or in the chamber of the resonator, wherein the deformable element affects the geometrical constraints of the resonator when being exposed to different gas turbine temperatures (e.g. to different temperatures of the turbine wall and/or gas temperatures of the gas stream). In other words, the deformable element is thermally coupled to the gas stream and/or the turbine wall of the turbine, so that for each respective gas temperature and/or wall temperature, a predetermined shape and thus predetermined geometrical constraints of the deformable element and thus of the resonator may be adapted. Because the deformable element is controlled by the temperature of the gas turbine, no further actuators or other movable mechanical elements need to be additionally installed. The resonator is self adjusting its damping frequency. Moreover, the needs of external control devices, such as computers, are not longer necessary for adjusting the resonator frequency with respect to the acoustical waves of the gas stream.

In other words, due to a predetermined shape of the deformable element with respect to predetermined respective gas turbine temperatures the resonator may provide different resonating frequencies at predefined differing operating conditions of the turbine.

The demanded deforming characteristics of the deformable element with respect to respective gas turbine temperatures may be defined during the design phase of the turbine. In the design phase, geometrical constraints will be considered for the resonator, so that the volume, the length and the diameter of the neck section and the chamber of the resonator will be selected to target the critical frequencies of the acoustical waves generated by the gas stream. This may be for instance a region of narrowband frequencies. Moreover, in the design phase the deformable element may be installed and adjusted to amend and adapt the volume, the length and/or the diameter or other geometrical constraints with respect to known frequency peaks at different operating loads of the gas turbine. In particular, for each operating load a specific temperature is generated by the turbine, so that the shape of the deforming element may be adapted to respective temperatures of the turbine. Thus, a change of the shape of the deformable element changes the geometrical constraints of the resonator and thus the frequency of the resonator may be shifted, so that the resonator may be matched to shift off the combustion dynamics peaks of the acoustical waves.

Moreover, additionally a plurality of shiftable resonators may be applied to the gas turbine, wherein in particular in comparison to conventional resonators, fewer shiftable resonating devices may be required to provide adsorption of the critical frequencies of the turbine at different operating loads.

For changing the shape of the deformable element by the influence of a temperature change, the material and the design of the deformable element may be defined via materials that comprise predefined coefficients of thermal expansions. Thus, by having the coefficient of thermal expenses for a certain material, the length expansion or reduction of the geometrical shape of the deformable element may be calculated due to respective temperatures that act on the deformable element.

In particular, the deformable element is installed to the neck section in such a way, that an effective diameter of the neck section depends on a respective gas turbine temperature (e.g. temperature of turbine wall or gas temperature of the gas stream). By the present exemplary embodiment, the deformable element may be expandable for instance to a centre line (centre) of the neck section in order to reduce the effective diameter and vice versa. Thus, by changing the effective diameter, the frequency of the resonator may be adjusted as well.

Furthermore, deformable element forms a spiral. The shape of the spiral—e.g. the distance between two windings or a radius of a most inner end of the spiral—depends on the respective gas turbine temperature (e.g. temperature of turbine wall or gas temperature of the gas stream) for selectively adapting the effective diameter of the neck section.

The spiral may be deformable in a two-dimensional plane, in particular deformable along a plane of the cross section of the neck section. The spiral may be formed out of windings, wherein each winding may be defined as a wall section of the spiral in a 360° (degree) section. Each winding of the spiral may change its distance to the adjacent winding of the spiral due to the influence of temperature. The spiral may be formed as a bimetallic strip element, for instance.

At a first temperature, the spiral may expand, so that the windings reduce the distance between each other and the spiral respectively the outer wall of the spiral is pressed against the inner surface of the neck section. Thus, because the contacting windings may form an offset from the inner surface of the neck section, the effective diameter, which may be defined from the winding closest to the centre of the neck section, may decrease and the effective cross-sectional area of the neck section decreases as well.

At a second temperature, the windings of the spiral may increase the distance between each other. Thereby, the effective diameter may be defined by the inner surface of the neck section, so that the effective diameter is larger than the effective diameter adjusted with the first temperature.

The spiral may also define a three-dimensional helix, so that a spiral may be deformable in a three-dimensional space. Thus, besides changing the effective diameter of the neck section, the helix may adjust the length of the neck section as well.

According to a further exemplary embodiment, the deformable element is thermally coupled to a wall of the gas turbine in such a way that the shape of the deformable element depends on (is indicative of) the respective wall temperature. The deformable element may be thermally coupled to the wall e.g. by a thermal conductive element located on a wall of the gas turbine. The deformable element is deformable under the influence of the temperature of the wall of the turbine. Thus, independently from the temperature of the gas stream of the turbine, the deformable element may be deformable due to the wall temperature.

In other words, the deformable element (e.g. a bimetallic element) may change the geometrical constraints of the resonator (e.g. the effective diameter or length of the neck section) if the (metal) wall (e.g. the combustor wall) temperature is used instead of and/or in combination with the gas stream temperature. If a highly (thermally) conductive element is connected to the combustor wall and to the deformable element inside the resonator (e.g. in particular the neck section), then even when the gas stream temperature will be constant, the resonator may exhibit differing frequencies due to differing metal (combustor wall) temperatures. This may be important if the resonator is placed in a flame region of the gas turbine (with high wall temperatures), because then a cooling of the resonator may be necessary and therefore the gas stream temperature within the resonator, in particular the neck section, will be kept relatively constant. The thermally conductive element may be connected to both, the deformable element and the turbine wall for providing a direct thermal conductivity. The turbine wall, in particular the combustor wall, may be manufactured from Inconel-625 and the thermal conductive element that may be placed on the combustor wall, may be made of Haynes-214. Both materials are temperature resistant and could be used around the flame area of the turbine. For lower temperatures, simpler metals such as Copper can be used for the thermally conductive element.

According to a further exemplary embodiment, the deformable element is thermally coupled to a gas stream of the gas turbine in such a way that the shape of the deformable element depends on (is indicative of) the gas stream temperature. Thus, due to temperature changes in the gas stream temperature, the geometrical constraints of the resonator (e.g. the effective diameter or length of the neck section) may be adjusted.

According to a further exemplary embodiment the deformable element comprises a bimetallic element. The bimetal may be used to convert a temperature change into a mechanical displacement of the deformable element. Therefore, the deformable element may comprise two layers of different materials with a different coefficient of thermal expansion. Both layers may be joined together throughout the length either by riveting, bracing or welding. The different expansion coefficients forces the bimetallic deformable element to deform or bend in a predetermined direction, wherein when cooling down the bimetallic element, the opposite direction is bent.

As bimetallic material for instance made of steel, copper or brass may be used. The use of the material for the bimetallic strip may depend on the desired coefficient of thermal expansion in order to provide a desired shape of the bimetallic strip with respect to respective temperatures.

According to a further exemplary embodiment, the deformable element is installed in the neck section of the resonator. When installing the deformable element in the neck section, the variables that cause a frequency change of the resonator may be changed effectively when the deforming of the deformable element changes the geometric constraints of the neck section. The geometrical constraints of the neck section that may be changed by the deformable element that is installed in the neck section may be the effective diameter of the neck section and thus the cross-sectional area of the neck section and/or the length of the neck section.

According to a further exemplary embodiment, the deformable element is installed to the neck section in such a way that the length of the neck section depends on the respective gas turbine temperature (e.g. temperature of the turbine wall or the gas temperature of the gas stream). By the present exemplary embodiment, a part of the neck section, in particular a part of the wall of the neck section for instance, may be formed by the deformable element or at least parts of it, so that an expansion and reduction of deformable element may change the length and such provides a frequency adjustment of the resonator.

According to a further exemplary embodiment, the deformable element is installed to the neck section in such a way that the volume of the neck section depends on the respective gas turbine temperature (e.g. temperature of the turbine wall or the gas temperature of the gas stream). By the present exemplary embodiment, the deformable element may change its volume or its position or expanse and thus the volume of the neck section due to a change of temperature. Thus, the volume of the neck station may be provided in order to adjust the frequency. Besides, strictly speaking the actual volume may stay unmodified, but the deformable element may create a blockage for the fluid so that effectively the volume does not change but the mobility of the gas through the neck section is influenced.

According to a further exemplary embodiment, the deformable element forms at least a part of the chamber, wherein the deformable element is installed to the chamber in such a way that the volume of the chamber depends on the respective gas turbine temperature (e.g. temperature of turbine wall or gas temperature of the gas stream). Thus, when the deformable element is a part of the wall element of the chamber, due to the deformation, in particular the expansion and reduction of the deformable element, the volume of the chamber and thus the resonator volume will be changed under the influence of temperature, so that the frequency of the resonator may be adjusted as well.

According to a further exemplary embodiment, the resonator further comprises a cooling hole, wherein the cooling hole is adapted for coupling the volume of the resonator to a cooling fluid stream. The cooling hole(s) may provide a connection to a cooling system, so that for example cooling fluid may stream inside the volume (the neck section or chamber) for cooling the resonator walls. Moreover, by the cooling holes, the cooling fluid may cool the gas stream, so that the gas stream temperature may be kept constant, for instance. Thus, by the cooling holes and by the cooling fluid, an adjusting effect for adjusting the deformation of the deformable element may be provided, because the gas stream temperature inside the resonator may be adjusted. This may become important if the resonator is placed in the flame region (with high wall temperatures) inside the gas turbine, then the resonator has to be cooled and therefore the gas stream temperature within the neck may be relatively constant.

According to a further exemplary embodiment, the resonator further comprises a plurality of deformable elements. Thus, in order to amplify the effect of the deformation of the deformable elements, a plurality of deformable elements may be installed in a resonator.

According to a further exemplary embodiment, a gas turbine comprises at least one resonator as described above. In a gas turbine, to a variety of locations, in particular to locations where critical acoustical waves are produced, an above-described resonator may be installed, so that at each location of the peaks of acoustical waves may be damped.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
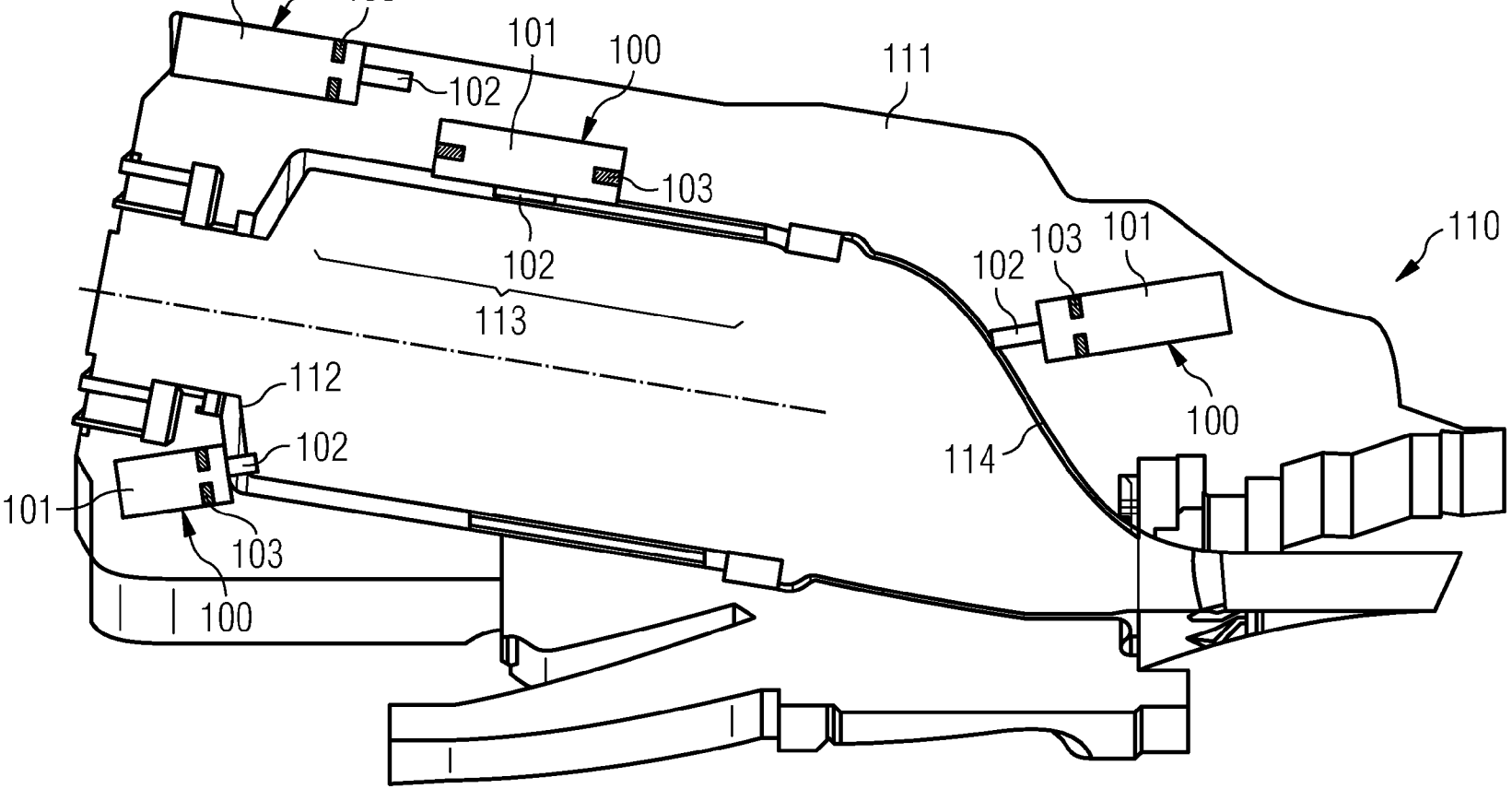
FIG. 1 illustrates a schematical view of a gas turbine with resonators according to an exemplary embodiment of the present invention.

The illustrations in the drawings are schematic. It is noted that in different figures similar or identical elements are provided with the same reference signs.

FIG. 1 shows a resonator 100 with an adaptable resonator frequency f for absorbing sound and/or pulsation or combustion dynamics generated by a gas stream of a gas turbine 110. The resonator 100 comprises a neck section 102, a chamber 101 and a deformable element 103 being deformable under influence of a change of a gas turbine temperature (e.g. temperature of turbine wall 601 (see FIG. 6) or gas temperature of the gas stream T) of the gas stream. The shape of the deformable element 103 is predetermined with respect to a respective gas turbine temperature. The neck section 102 and the chamber 101 form a volume V of the resonator 100. The neck section 102 forms a passage coupling the volume V with the gas turbine 110. The deformable element 103 is thermally coupled to the gas stream in such a way that the shape of the deformable element 103 depends on the respective gas turbine temperature.

As shown in FIG. 1, resonators 100 may be located inside a gas turbine 110 at several desired locations, in particular where a high noise, in particular high acoustical waves are generated. As seen in FIG. 1, acoustical waves may be generated in the region of the casing 111 of the gas turbine 110, so that a resonator 100 may be installed to the casing 111 for absorbing the acoustical waves. Moreover, the resonator 100 may be installed to the section 112 of the combustion chamber close to the fuel injector and/or in an area in which the combustion chamber expands. Moreover, the flame dynamics, in particular when burning a lean fuel mixture, produce acoustical sound in particular in the flame section 113 of the gas turbine 110, so that it might be beneficial to provide resonators 100 in the vicinity of the flame section 113. In a further exemplary embodiment, the resonators 100 may also be placed to an exhaustion region 114 of the combustor chamber in order to absorb the acoustical waves that may be produced by the combustion process inside the combustor chamber.

Figure 2:
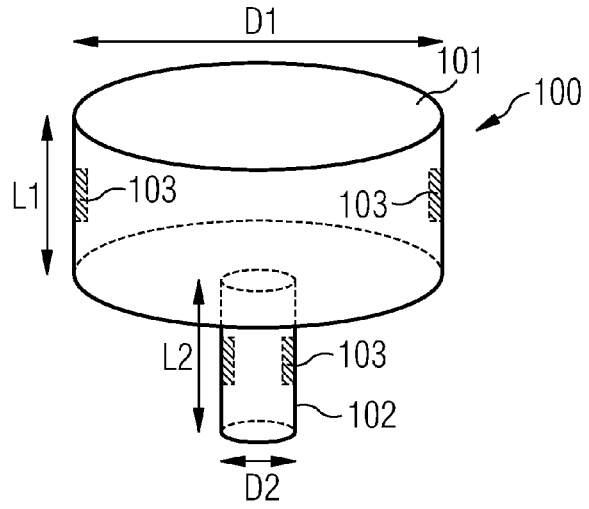
FIG. 2 discloses a schematical view of a resonator according to an exemplary embodiment.

FIG. 2 illustrates schematically a resonator 100 comprising the chamber 101 and the neck section 102. The deformable elements 103 may be installed in the vicinity of the chamber 101 and/or the neck section 102. The deformable elements 103 may be arranged circumferentially at the inner surfaces of the chamber 101 and/or the neck section 102.

The chamber 101 of the resonator 100 may provide a larger volume than the neck section 102. The neck section 102 provides a tight opening for connecting the chamber 102 to the outside. The gas in the volume of the chamber 102 provides an elasticity, wherein the gas inside the neck section 102 provides an inertia mass of the gas. Thus, the frequency may be defined by the formula:

$$F = \sqrt{\frac{\text{elasticity}}{inertialmass}}$$

In particular, the frequency of such a resonator may be defined by:

$$F = \frac{c}{2\pi}\sqrt{\frac{S}{l}\cdot V}$$

wherein the speed of sound c is dependent on the temperature T:

$$c = \sqrt{\frac{\kappa \cdot R \cdot T}{M}}$$

Thus, for different operating loads of the gas turbine 110 and thus due to the different gas stream temperatures T or for different wall temperatures for each operating load, the frequency f of the resonator has to be changed in order to provide damping characteristics. This change of frequency f may be compensated and adapted by the deformable element 103. The deformable element 103 changes the geometrical constraints of the resonator 100 in such a way that a desired frequency f may be adapted, in particular with respect to the operating loads of the turbine 110 and thus to varying gas stream temperatures T and wall temperatures of the gas temperature.

Figure 3:
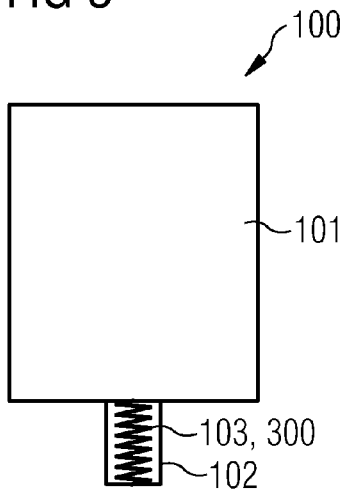
FIG. 3 illustrates a schematical view of a resonator comprising a deformable element in a neck section according to an exemplary embodiment of the present invention.

FIG. 3 illustrates a schematical view of a resonator 100 comprising the chamber 101 and the neck section 102. Inside the neck section 102 the deformable element 103 is installed. The deformable element 103 is only shown symbolically. The deformable element 103 may be in the exemplary embodiment of FIG. 3 a spiral 300. The spiral 300 may be deformable along a two-dimensional plane respectively along the cross-sectional area of the neck section 102, so that the effective diameter $D_{2,eff}$ and thus the effective cross-sectional area S of the neck section 102 may be changed and adapted by the deformation of the spiral 300. As indicated in FIG. 3, the spiral 300 may also be formed as a helix, so that also besides the two-dimensional deformation a three-dimensional deformation along the length $l_2$ of the neck section 102 may be provided.

Figure 4A:
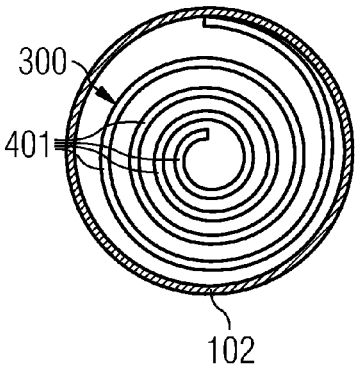
FIG. 4A and FIG. 4B illustrate schematical views of a spiral in a neck section according to an exemplary embodiment of the present invention.
Figure 4B:
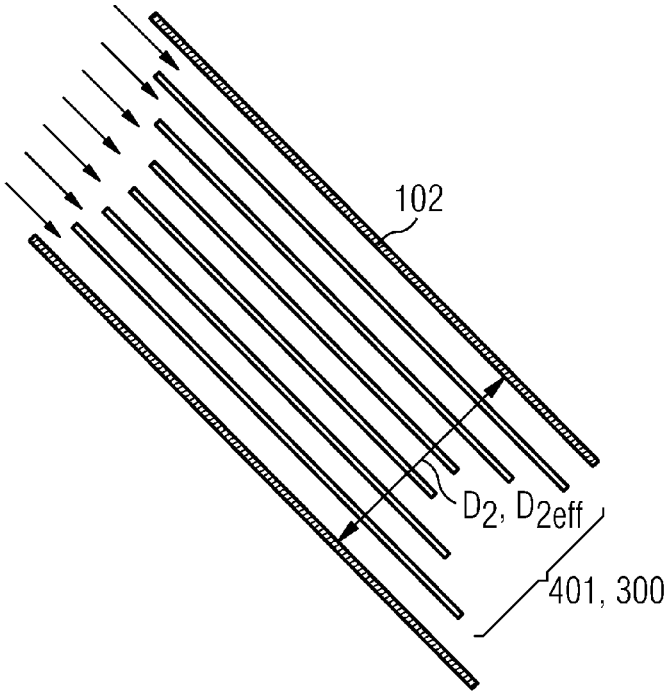

FIG. 4A and FIG. 4B illustrate the spiral 300 inside the neck section 102 in more detail. The spiral 300 comprises a plurality of windings 401. Each winding may be designed as a section of the spiral 300 along a 360° (degree) section. FIG. 4A and FIG. 4B illustrate the spiral 300 in a loose state. This loose state may be adjusted by the first temperature (of the wall 601 of the turbine 110 and/or the gas stream) acting on the spiral 300. As shown in FIG. 4A, the windings 401 are spaced between each other. In this loose state, the effective diameter $D_{2,eff}$ may be defined as the diameter $D_2$ of the inner surface of the neck section 102. In particular, as shown in FIG. 4B, the spaced windings 401 form a guidance for the fluid stream, so that a laminar fluid stream inside the neck section 102 may be provided. Thus, flow resistance is reduced and the effective diameter $D_{2,eff}$ may be defined as the diameter $D_2$ of the neck section 102.

Figure 5A:
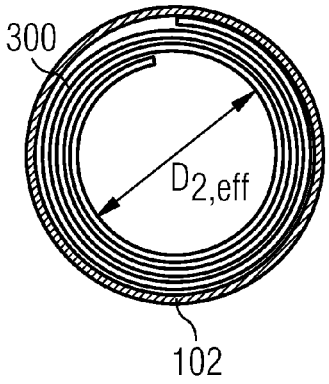
FIG. 5A and FIG. 5B illustrate a schematical view of a spiral inside a neck section of the resonator with a different shape with respect to FIG. 4A and FIG. 4B.
Figure 5B:
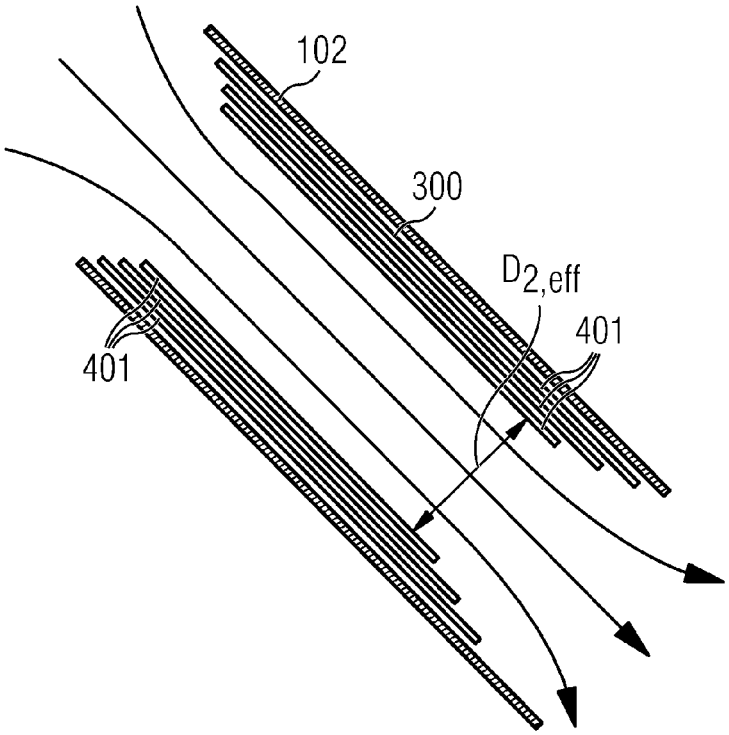

FIG. 5A and FIG. 5B show a status of the spiral 300 at a second temperature (e.g. of the wall 601 of the turbine 110 and/or the gas stream) that differs to the first temperature. As can be seen in FIG. 5A and FIG. 5B, the windings 401 of the spiral abut against each other due to a deformation, i.e. expansion, of the spiral 300. Thus, the winding 401 forms virtually an offset inside the neck section 102, so that the effective diameter $D_{2,eff}$ of the neck section 102 is not longer defined by the diameter $D_2$ of the neck section 102, but is defined as the diameter between the winding 401 that is located closest to the centre of the neck section 102. Therefore also the volume of the neck section 102 changes, because the cross-section of the neck section 102 which is available for the fluid is reduced from diameter $D_2$ to the effective diameter $D_{2,eff}$.

Thus, due to the different effective diameter $D_{2,eff}$ at a first temperature (see FIG. 4A, 4B) and a second temperature (see FIG. 5A, 5B) a corresponding frequency of the resonator 100 may be adjusted.

Figure 6:
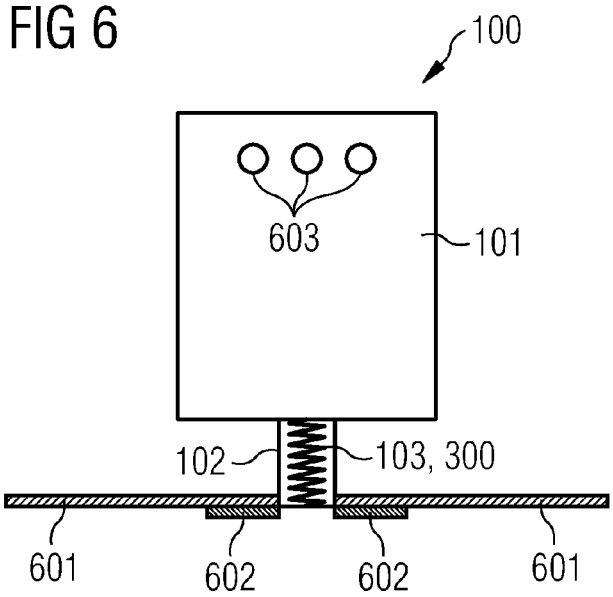
FIG. 6 illustrates a schematical view of the resonator thermally coupled to a wall of a gas turbine according to an exemplary embodiment of the present invention.

FIG. 6 shows a resonator 100 comprising cooling holes 603. The resonator shown in FIG. 6 is thermally coupled to a wall 601 of the gas turbine 110 (e.g. shown in FIG. 1). For improving the thermal coupling between the deformable element 103 and the wall 601, thermally conductive elements 602 may be located between the deformable element 103 and the wall 601. The thermally conductive element 602 may comprise a metal sheet, for example.

The hot gas stream of the gas turbine 110 may be cooled by cooling fluid streaming into or around the resonator 100. Through the cooling holes 603, the cooling fluid may enter the volume inside the resonator 100, so that the wall of the resonator 100, the deformable element 103 and/or the gas stream may be cooled. Thus, the resonator 100 may be located also to high temperature regions of the gas turbine 100, such as to the combustion chamber and the flame section 113 of the gas turbine 110.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A resonator with an adaptable resonator frequency for absorbing sound generated by a gas stream of a gas turbine, the resonator comprising:

a neck section, a chamber, and a deformable element being deformable under influence of a change of a gas turbine temperature, wherein the deformable element is a bimetallic element and forms a spiral, wherein the shape of the deformable element is predetermined with respect to a respective gas turbine temperature, wherein the neck section and the chamber form a volume of the resonator, wherein the neck section forms a passage coupling the volume with the gas turbine, wherein the deformable element is thermally coupleable to the gas turbine in such a way that the shape of the deformable element depends on the respective gas turbine temperature, wherein the deformable element is installed in the neck section in such a way that an effective diameter of the neck section depends on the gas turbine temperature, and wherein a shape of the spiral depends on the respective gas turbine temperature for selectively adapting the effective diameter of the neck section.

2. The resonator of claim 1, wherein the deformable element is thermally coupled to a wall of the gas turbine in such a way that the shape of the deformable element depends on the respective wall temperature.

3. The resonator of claim 1, wherein the deformable element is thermally coupled to a gas stream of the gas turbine in such a way that the shape of the deformable element depends on the gas stream temperature.

4. The resonator of claim 1, wherein the deformable element is installed to the neck section in such a way that a length of the neck section depends on the respective gas turbine temperature.

5. The resonator of claim 1, wherein the deformable element is installed to the neck section in such a way, that a volume of the neck section depends on the respective gas turbine temperature.

6. The resonator of claim 1, further comprising a cooling hole, wherein the cooling hole is adapted for coupling the volume of the resonator to a cooling fluid stream.

7. The resonator of claim 1, further comprising a plurality of deformable elements.

8. A gas turbine generating a gas stream, comprising:

at least one resonator according to claim 1.

9. A method of producing a resonator with an adaptable resonator frequency for absorbing sound generated by a gas stream of a gas turbine, the method comprising:

forming a volume of the resonator by a neck section and a chamber, forming a passage by the neck section coupling the volume to the gas turbine, thermally coupling a deformable bimetallic element forming a spiral to the gas turbine in such a way that the shape of the deformable bimetallic element depends on the respective gas turbine temperature, wherein the deformable bimetallic element is installed to the neck section in such a way that an effective diameter of the neck section depends on the gas turbine temperature, wherein a shape of the spiral depends on the respective gas turbine temperature for selectively adapting the effective diameter of the neck section.

* * * * *